United States Patent [19]

Iida

[11] 4,298,145

[45] Nov. 3, 1981

[54] ADAPTER FOR A CONTAINER

[76] Inventor: Motoyori Iida, 106, 4-chome, Kasugaoka, Itami-shi, Hyogo-ken, Japan

[21] Appl. No.: 82,588

[22] Filed: Oct. 9, 1979

[30] Foreign Application Priority Data

Mar. 9, 1979 [JP] Japan ..... 54-31436[U]

[51] Int. Cl.[3] ..... B67D 3/00; B65D 51/16

[52] U.S. Cl. ..... 222/478; 215/309; 222/109; 222/571

[58] Field of Search ..... 222/109, 566, 567, 571, 222/575, 478, 479; 215/307, 309; 220/8.5 SP, DIG. 5

[56] References Cited

U.S. PATENT DOCUMENTS

| | | | |
|---|---|---|---|
| 2,763,402 | 9/1956 | Livingstone | 222/568 X |
| 2,780,391 | 2/1957 | Jasuta | 222/478 X |
| 3,145,887 | 8/1964 | Reller et al. | 222/571 |
| 3,184,125 | 5/1965 | Jutzi | 222/479 |
| 3,198,393 | 8/1965 | Kitterman | 222/571 X |
| 3,369,710 | 2/1968 | Lucas | 222/109 |
| 3,833,150 | 9/1974 | Visser-Patings | 222/571 X |

FOREIGN PATENT DOCUMENTS

| | | | |
|---|---|---|---|
| 1493125 | 8/1967 | France | 222/567 |
| 372563 | 11/1963 | Switzerland | 215/307 |
| 297565 | 9/1928 | United Kingdom | 222/571 |

*Primary Examiner*—Robert J. Spar
*Assistant Examiner*—Edward M. Wacyra
*Attorney, Agent, or Firm*—Wenderoth, Lind & Ponack

[57] ABSTRACT

An improved adapter for a container such as for example, a cooking oil container, is described which includes an outer tube, an inner tube and a drip return guide plate. A hole is located in the lowest part of the guide plate and operates as both a drip passage and as an air venting port.

5 Claims, 2 Drawing Figures

ADAPTER FOR A CONTAINER

BACKGROUND OF THE INVENTION

The present invention relates to an adapter for a container, such as a container of cooking oil, which can be mounted on the pouring mouth of the container.

In conventional containers for a liquid, particularly containers for cooking oil, the outer wall is often soiled with the liquid that has dripped over the edge of its pouring mouth. Such dripping also soils the table, hand, etc. Various attempts have been made to remedy this problem, however, a satisfactory solution has not yet been developed.

SUMMARY OF THE INVENTION

An object of the invention is to provide an adapter which eliminates the above-described problem.

Other features and advantages of this invention will become apparent from the following description taken with reference to the accompanying drawings.

DETAILED DESCRIPTION OF THE INVENTION

Figure 1:
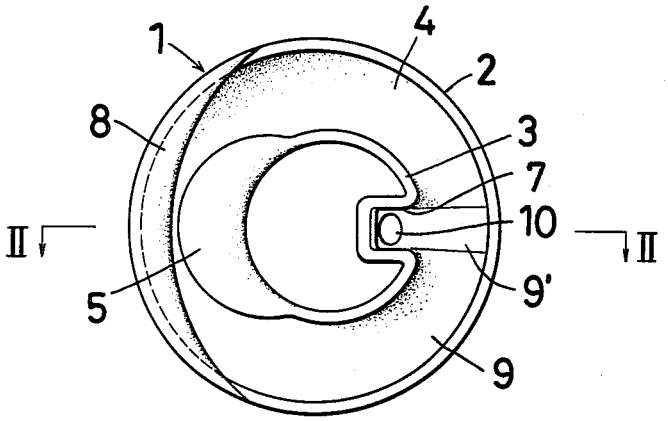
FIG. 1 is a plan view of a preferred embodiment of the invention.
Figure 2:
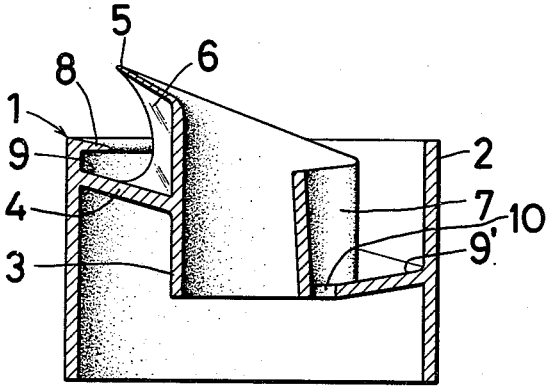
FIG. 2 is a vertical sectional view of the same embodiment of FIG. 1 taken along the line II—II of FIG. 1.

Referring to the drawing, an adapter according to the present invention is generally designated by numeral 1 and includes an outer tube 2 which is adapted for mounting on the mouth of a bottle or container. An inner tube 3 is disposed within the outer tube 2 with a space therebetween, and a guide plate 4 connects the inner tube 3 and the outer tube 2 together.

The inner tube 3 has a pouring lip 5 which extends outwardly from its upper edge and a tongue 6 is disposed under the pouring lip 5 along the outer wall of the inner tube 3 and extends vertically at a right angle with respect to the pouring lip. There is a groove 7 which extends axially at a position opposite to the pouring lip 5. The lip is thinner than the tube body for minimizing the drip. The groove 7 has a cross-sectional area which increases gradually toward its top.

The outer tube has a baffle plate 8 which extends inwardly from part of its upper edge. The baffle plate can be located either only near the pouring lip 5 as illustrated in FIG. 1 or over the entire periphery of the outer tube 2.

The guide plate 4 includes a first inclined surface 9 located under the baffle plate 8 and slanting downwardly and a second inclined surface 9' slanting downwardly, from the wall of the outer tube opposite to the baffle plate 8, to the groove 7. A hole 10 is located in the guide plate 4 at the end of the second inclined surface 9' at the bottom of the groove 7.

In use, the adapter of the present invention is mounted on the pouring mouth of a container containing e.g. oil. The outer tube 2 may either be adapted to be fitted on the mouth of the container or to be threadedly mounted thereon.

When the container is tilted with the adapter mounted thereof, the liquid contained therein will flow through the inner tube 3 and from the pouring lip 5. If the container is fully filled or it is tilted quickly, the liquid will flow not only through the inner tube 3 but also through the hole 10. The hole 10 also serves to such an amount of air into the container for assuring a smooth discharge of the liquid out of the container. The liquid flowing out of the hole 10 will flow in the groove 7 and join the main flow through the inner tube without entering the passage formed between the outer tube and the inner tube. This is assured by the particular design of the groove, which is wider at top than at the bottom.

When pouring with this adapter mounted on the container, if the speed at which the liquid flows off the pouring lip 5 is sufficiently high, the liquid will hardly drip or flow down the underside of the pouring lip. However, when the speed is low, e.g. at the end of pouring operation, a small amount of liquid will tend to drip. This tendency is particularly large with a liquid having a large viscosity such as that of oil.

Even if the liquid drips over the brim of the pouring lip, it flows down the tongue 6 is guided thereby, into the space between the inner and outer tubes, down the first inclined surface 9 and then down the second inclined surface 9' and back into the container through the hole 10.

If the container is re-tilted with some amount of liquid remaining on the first inclined surface 9, such liquid will flow back toward the pouring lip 5 but the baffle plate 8 will prevent it from overflowing the outer tube 2.

Two caps may be provided, one for the outer tube and the other for the inner tube, to keep off dust and avoid soiling the adapter with liquid.

It will be understood from the foregoing that the adapter according to this invention eliminates the possibility of smudging the outer surface of the container with the drip. The hole 10 serves not only as a drip return port but also as an air venting port.

Further, it will be understood that various changes or modifications may be made that are within the scope of this invention.

What I claim:

1. An adapter for a liquid container comprising:

an outer tube for mounting on a liquid container;

an inner tube having a pouring lip on its upper edge on one side thereof and a groove on the outer surface thereof which extends from the top end of said inner tube, at a position opposite to said pouring lip, to the bottom end thereof;

said inner tube including a wall which separates said groove from the interior space of said inner tube; and a guide plate connecting said outer tube and inner tube together, said guide plate being inclined from under said pouring lip toward the lower end of said groove, said guide plate having a hole located at a position within said groove for venting air therethrough.

2. An adapter as in claim 1 further comprising a tongue located under said pouring lip and extending from said pouring lip to said guide plate.

3. An adapter as in claim 1 further comprising a baffle plate located at the top edge of said outer tube adjacent said pouring lip, said baffle plate extending inwardly toward said inner tube.

4. An adapter as in claim 1 wherein said guide plate includes a first inclined surface and a second inclined surface, said first inclined surface being inclined and extending from under said pouring spout toward said groove, and said second inclined surface extending from the inside of said outer tube adjacent said groove toward said groove and said hole, said second inclined surface being inclined from the lowest point of said first inclined surface toward said groove and said hole.

5. An adapter as in claim 1 wherein said groove is wider at the top end and tapers to be narrower at the lower end thereof.

* * * * *